US008733903B2

(12) United States Patent
Gao et al.

(10) Patent No.: US 8,733,903 B2
(45) Date of Patent: May 27, 2014

(54) LIQUID DISPENSER INCLUDING PASSIVE PRE-STRESSED FLEXIBLE MEMBRANE

(75) Inventors: Zhanjun Gao, Rochester, NY (US); Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/552,752

(22) Filed: Jul. 19, 2012

(65) Prior Publication Data

US 2014/0022308 A1 Jan. 23, 2014

(51) Int. Cl.
*B41J 2/05* (2006.01)

(52) U.S. Cl.
USPC ..... 347/65; 347/67

(58) Field of Classification Search
None
See application file for complete search history.

(56) References Cited

U.S. PATENT DOCUMENTS

| | | | | |
|---|---|---|---|---|
| 1,329,559 | A | 2/1920 | Tesla | |
| 3,614,677 | A | 10/1971 | Wilfinger | |
| 4,480,259 | A | 10/1984 | Kruger et al. | |
| 6,130,690 | A | 10/2000 | Ahn | |
| 6,284,436 | B1 * | 9/2001 | Ahn et al. | 430/320 |
| 6,312,109 | B1 | 11/2001 | Chen | |
| 6,336,711 | B1 | 1/2002 | Ahn | |
| 6,345,883 | B1 | 2/2002 | Shin et al. | |
| 6,378,991 | B1 | 4/2002 | Lim et al. | |
| 6,431,688 | B1 | 8/2002 | Shin et al. | |
| 6,436,301 | B1 * | 8/2002 | Hiroki et al. | 216/27 |
| 6,705,716 | B2 | 3/2004 | Mott | |

FOREIGN PATENT DOCUMENTS

| | | |
|---|---|---|
| EP | 0 845 358 | 6/1998 |
| EP | 0 882 592 | 9/2005 |

OTHER PUBLICATIONS

Scheeper et al., "The Design, Fabrication, and Testing of Corrugated Silicon Nitride Diaphragms", *Journal of Microelectromechanical Systems*, vol. 3, No. 1, Mar. 1994, pp. 36-42.

Deng et al., "Optimization of No-Moving Part fluidic Resistance Microvalves With Low Reynolds Number", 978-1-4244-5764-9/10 2010 IEEE, pp. 67-70.

* cited by examiner

*Primary Examiner* — Geoffrey Mruk
(74) *Attorney, Agent, or Firm* — William R. Zimmerli

(57) ABSTRACT

A liquid dispenser includes first and second liquid chambers. The second liquid chamber is in fluid communication with liquid supply and liquid return channels. A flexible membrane separates and fluidically seals the first and second liquid chambers from each other. The flexible membrane, residing in a first position, includes a residual compressive stress that exceeds an onset buckling stress of the flexible membrane. A heater, associated with the second liquid chamber, is selectively actuated to create a pressure pulse in a liquid that causes the flexible membrane to move from the first position to a second position to eject liquid through a nozzle of the first liquid chamber. In one embodiment, a liquid supply provides liquid that flows continuously from the liquid supply through the liquid supply channel through the second liquid chamber through the liquid return channel and back to the liquid supply during a drop dispensing operation.

9 Claims, 5 Drawing Sheets

(c)

LIQUID DISPENSER INCLUDING PASSIVE PRE-STRESSED FLEXIBLE MEMBRANE

CROSS REFERENCE TO RELATED APPLICATIONS

Reference is made to commonly-assigned, U.S. patent application Ser. No. 13/552,743, entitled "LIQUID DISPENSER INCLUDING ACTIVE MEMBRANE ACTUATOR", Ser. No. 13/552,763, entitled "LIQUID DISPENSER INCLUDING ASYMMETRIC NOZZLE ACTUATOR CONFIGURATION", all filed concurrently herewith.

FIELD OF THE INVENTION

This invention relates generally to the field of digitally controlled liquid dispensing devices and, in particular, to liquid dispensing devices that include a flexible membrane.

BACKGROUND OF THE INVENTION

Ink jet printing has become recognized as a prominent contender in the digitally controlled, electronic printing arena because of its non-impact, low-noise characteristics, its use of plain paper, and its avoidance of toner transfer and fixing. Ink jet printing mechanisms can be categorized by technology as either drop on demand ink jet (DOD) or continuous ink jet (CU).

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop on demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop on demand printing devices—heat actuators and piezoelectric actuators. When a piezoelectric actuator is used, an electric field is applied to a piezoelectric material possessing properties causing a wall of a liquid chamber adjacent to a nozzle to be displaced, thereby producing a pumping action that causes an ink droplet to be expelled. When a heat actuator is used, a heater, placed at a convenient location adjacent to the nozzle, heats the ink. Typically, this causes a quantity of ink to phase change into a gaseous steam bubble that displaces the ink in the ink chamber sufficiently for an ink droplet to be expelled through a nozzle of the ink chamber.

In some applications it may be desirable to use an ink that is not aqueous and, as such, does not easily form a vapor bubble under the action of the heater. Heating some inks may cause deterioration of the ink properties, which can cause reliability and quality issues. As described in U.S. Pat. No. 4,480,259 and U.S. Pat. No. 6,705,716, one solution is to have two fluids in the print head with one fluid dedicated to respond to an actuator, for example, to create a vapor bubble upon heating, while the other fluid is the ink. The performance capabilities of these types of print heads are often limited due to the resistance of the membrane or diaphragm that separates the actuator fluid from the ink which reduces the amount of volumetric displacement that occurs in ink chamber as a result of the pressure caused by the vaporization of the actuator fluid. Although U.S. Pat. No. 4,480,259 and U.S. Pat. No. 6,705,716 both describe flexible diaphragms, it is well understood by one skilled in the art that it is difficult to manufacture a micro-fluidics device such as an ink jet print head using conventional MEMS technology while incorporating a sufficiently elastic material for use as a diaphragm. Additionally, repeated cycles of stretch and relax cause material fatigue in the diaphragm resulting in reduced device reliability and poor device performance.

As such, there is an ongoing effort to increase the reliability and performance of print heads that include two fluids and a flexible membrane.

SUMMARY OF THE INVENTION

According to an aspect of the present invention, a liquid dispenser includes a first liquid chamber and a second liquid chamber. The first liquid chamber includes a nozzle. The second liquid chamber is in fluid communication with a liquid supply channel and a liquid return channel. A flexible membrane separates and fluidically seals the first liquid chamber and the second liquid chamber from each other. The flexible membrane includes a residual compressive stress that exceeds an onset buckling stress of the flexible membrane. The flexible membrane resides or is initially located in a first position. A heater, associated with the second liquid chamber, is selectively actuated to create a pressure pulse in a liquid that causes the flexible membrane to move from the first position to a second position to eject liquid through the nozzle of the first liquid chamber. In one embodiment, a liquid supply provides liquid that flows continuously from the liquid supply through the liquid supply channel through the second liquid chamber through the liquid return channel and back to the liquid supply during a drop dispensing operation.

According to another aspect of the present invention, a method of printing includes providing a liquid dispenser made in accordance with the invention described herein and using it to dispense liquid drops.

In one example embodiment of the invention, the liquid in the second liquid chamber is different from the liquid in the first chamber. Commonly referred to as a working fluid, the liquid in the second chamber has different characteristics when compared to the liquid in the first liquid chamber. For example, the working fluid can have a lower boiling point when compared to first liquid. The working fluid can also be a non-corrosive liquid such as a nonionic liquid.

In one example embodiment of the invention, the heater is a bubble jet type heater that creates the pressure pulse by vaporizing a portion of the liquid in the second chamber. The heater can include a split heater structure or configuration. In one example embodiment of the invention, the flexible membrane is under a compressive pre-stress such that it resides in a first position or location but switches to a second position or location using a snap-through motion when lateral force is applied on the flexible membrane.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
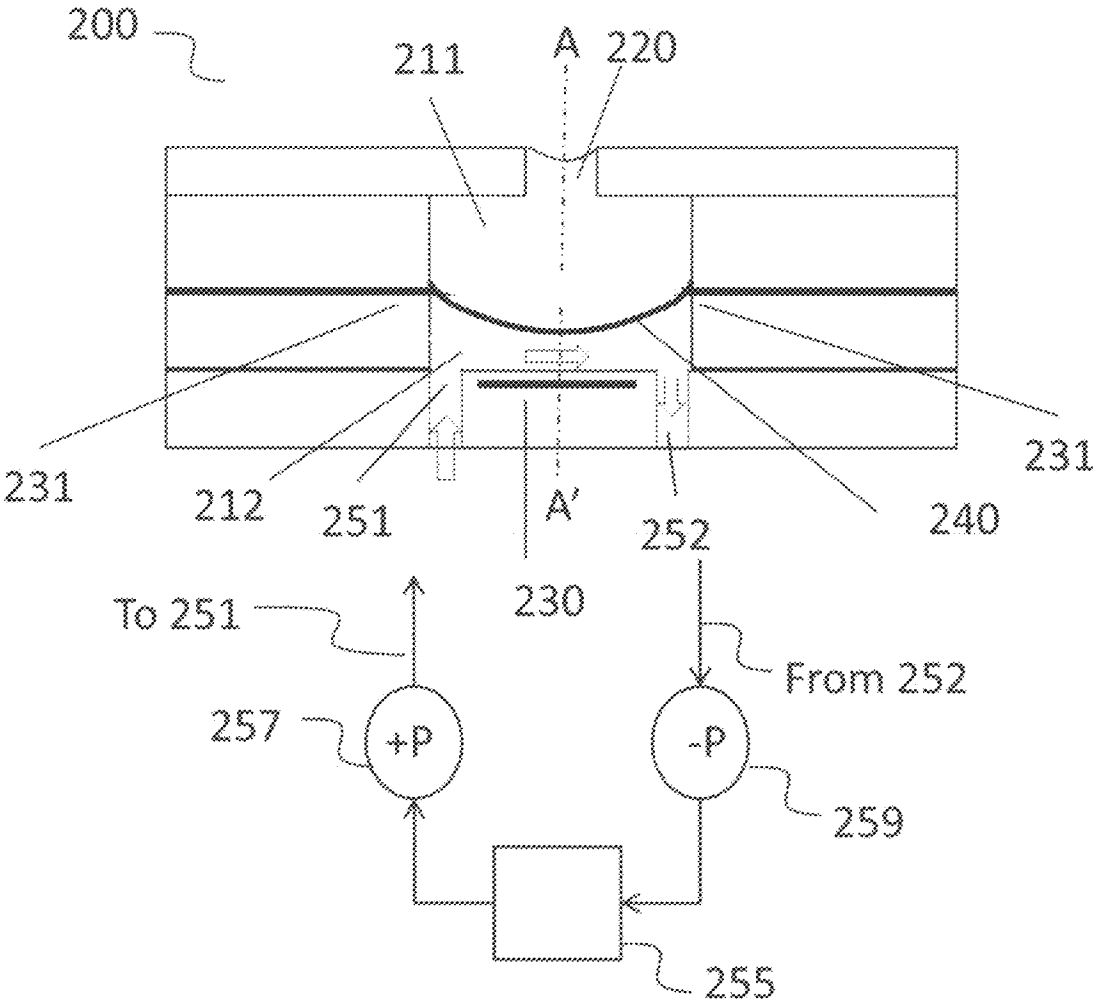
FIG. 1 is a schematic cross sectional view of an example embodiment of a liquid dispenser made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a print head, which is particularly useful in digitally controlled inkjet printing devices in which drops of ink are ejected from a print head toward a print medium. However, many other applications are emerging which use liquid dispensers, similar to inkjet print heads, to emit liquids, other than inks, that need to be finely metered and deposited with high spatial precision. As such, as described herein, the terms "liquid" and "ink" are used interchangeably and refer to any material, not just inkjet inks, which can be ejected by the example embodiments of the liquid dispenser described below.

In addition to inkjet printing applications in which the fluid typically includes a colorant for printing an image, the liquid dispenser of the present invention is also advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The liquid dispenser of the present invention provides sufficient force to eject fluids having a higher viscosity than typical inkjet inks, and does not impart excessive heat into the fluids that could damage the fluids or change their properties undesirably.

Referring to FIG. 1, a liquid dispenser 200 including a membrane MEMS actuator is shown. Liquid dispenser 200 includes a first liquid chamber 211 and a second liquid chamber 212. First liquid chamber 211 includes a nozzle 220. A flexible membrane 240 is positioned in liquid dispenser 200 to separate and fluidically seal the first liquid chamber 211 and the second liquid chamber 212 from each other. As shown in FIG. 1, flexible membrane 240 bows away from nozzle 220 when in an unactuated position or state (often referred to as an at rest position or state). The overall shape of flexible membrane 240 is concave relative to first chamber 211 or convex relative to second chamber 212 when viewed from end to end of flexible membrane 240 along a plane that separates first chamber 211 and second chamber 212 from each other.

Liquid dispenser 200 includes a selectively actuatable thermal actuator that uses heat energy to divert a portion a liquid (often referred to as a first liquid) located in first liquid chamber 211 through nozzle 220. The thermal actuator includes a heater in one example embodiment of the invention that is commonly referred to as a "bubble jet" heater. When selectively actuated, the heat generated by this type of thermal actuator vaporizes a portion of a liquid (often referred to as a second liquid) in the vicinity of the actuator creating a vapor bubble 260 (shown in FIG. 2) which causes the first liquid to the ejected through nozzle 220.

Referring back to FIG. 1, a heater 230 is associated with second liquid chamber 212. Heater 230 is located in a wall of the second liquid chamber 212 opposite flexible membrane 240. As shown in FIG. 1, heater 230 is a "bubble jet" type heater. A center axis A-A' extends through the center of nozzle 220. Nozzle 220 includes a center point, heater 230 includes a center point, and flexible membrane 240 includes a center point. As shown in FIG. 1, the center points of nozzle 220, heater 230, and flexible membrane 240 are collinear relative to each other and located on center axis A-A'. The overall shape of flexible membrane 240 is symmetric relative to center axis A-A' when viewed, as shown in FIG. 1, from end to end of flexible membrane 240.

First chamber 211 is adapted to receive a liquid that is supplied to first chamber 211 in a conventional manner. Second chamber 212 is adapted to receive a liquid that is supplied to second chamber 212 in a conventional manner or in a manner according to one aspect of the present invention (described in more detail below). As flexible membrane 240 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention.

Figure 2:
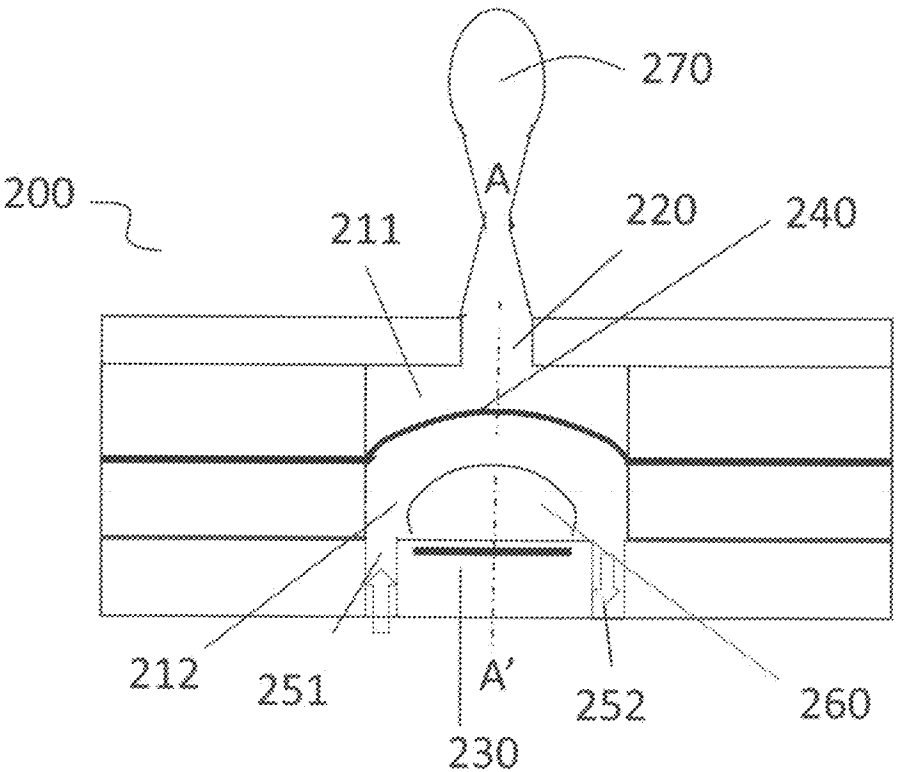
FIG. 2 is a schematic cross sectional view of the example embodiment shown in FIG. 1 in an actuated state.

Referring to FIG. 2, a portion of a liquid (often referred to as a second liquid) located in second liquid chamber 212 is vaporized, forming a vapor bubble 260, when electric energy is applied to heater 230. The pressure resulting from the expanding vapor bubble 260 pushes flexible membrane 240 toward nozzle 220 (up as shown in FIG. 2) and causes flexible membrane 240 to bend toward nozzle 220. This can also be referred to as an actuated position or state of flexible membrane 240. The displacement of the flexible membrane 240 pressurizes a liquid (often referred to as a first liquid) located in first liquid chamber 211 causing a liquid drop 270 to be ejected through nozzle 220.

Figure 3:
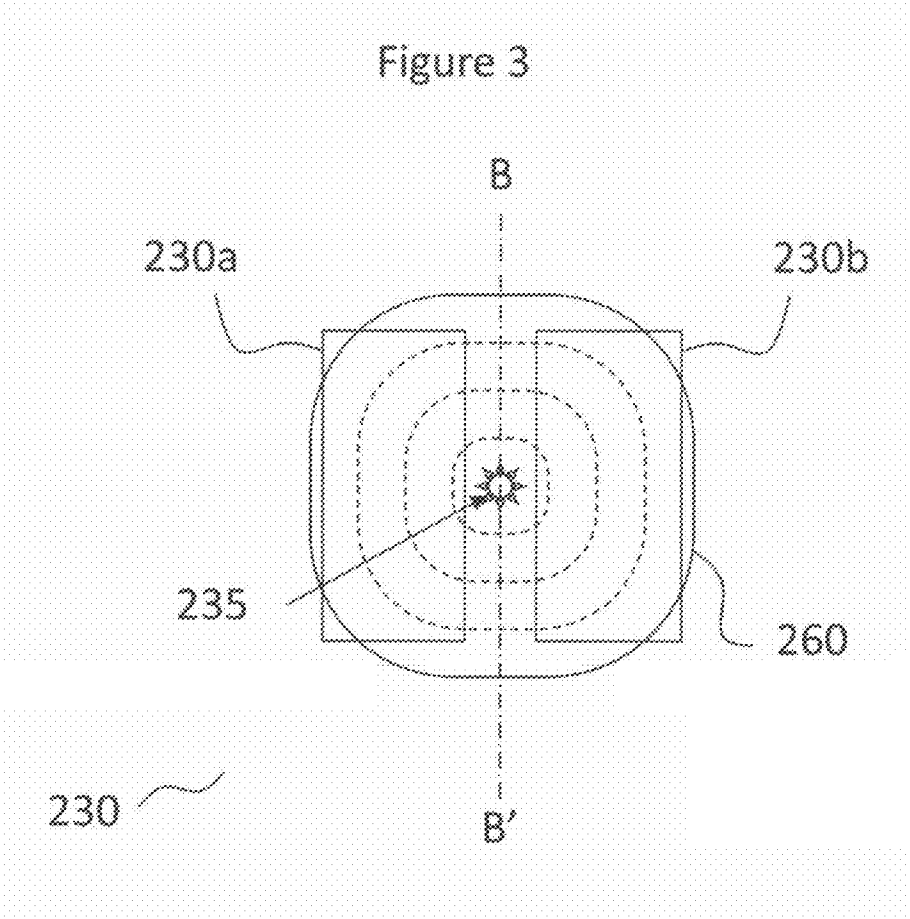
FIG. 3 is a schematic top view of an example embodiment of a heater included in an example embodiment of a liquid dispenser made in accordance with the present invention.

Referring to FIG. 3, heater 230 includes a split heater structure as viewed along the direction of center axis A-A' (in FIG. 3 center axis A-A' extends into and out of the figure). The split heater 230 includes two halves 230*a* and 230*b* symmetrically positioned relative to a plane B-B' that includes the center point 235 of the heater 230. Vapor bubble 260 is shown in FIG. 3 as concentric rings (using dashed lines). The split heater configuration allows vapor bubble 260 to collapse at the center point 235 of the heater 230, reducing or even avoiding cavitation damage to the heater. Other heater 230 structures or configurations can be included in alternative example embodiments of the invention.

Referring to back to FIGS. 1-3, according to one aspect of the present invention, liquid dispenser 200 is provided with a circulating working fluid (also referred to as a second liquid). As described above, liquid dispenser 200 includes a first liquid chamber 211 that is in fluid communication with a nozzle 220. A heater 230 is associated with a second liquid chamber 212. A flexible membrane 240 is positioned to separate and fluidically seal the first liquid chamber 211 and the second liquid chamber 212 from each other. A thermal actuator, for example, a heater 230, is located in a wall of second liquid chamber 212 opposite flexible membrane 240.

A liquid supply channel 251 is in fluid communication with second chamber 212 and a liquid return channel 252 is in fluid communication with second chamber 212. Liquid supply channel 251 and liquid return channel 252 are also in fluid communication with a liquid supply 255. During a drop ejection or dispensing operation, liquid supply 255 provides a liquid (commonly referred to as a working fluid or a working liquid) that flows continuously from liquid supply 255 through liquid supply channel 251 through second liquid chamber 212 through liquid return channel 252 and back to liquid supply 255. The circulating working fluid helps to increase the drop ejection frequency by removing at least some of the heat generated by heater 230 when it is actuated during drop ejection. The circulating working fluid can help increase the drop ejection frequency by pushing at least some of vapor bubble 260 off of and away from the heater 230 area as vapor bubble 260 collapses or increasing the speed of liquid replenishment relative to (over as shown in FIG. 2) heater 230.

A regulated pressure source 257 is positioned in fluid communication between liquid supply 255 and liquid supply channel 251. Regulated pressure source 257, for example, a pump, provides a positive pressure that is usually above atmospheric pressure. Optionally, a regulated vacuum supply 259, for example, a pump, can be included in order to better control liquid flow through second chamber 212. Typically, regulated vacuum supply 259 is positioned in fluid communication between liquid return channel 252 and liquid supply 255 and provides a vacuum (negative) pressure that is below atmospheric pressure. Liquid supply 255, regulated pressure source 257, and optional regulated vacuum supply 259 can be referred to as the liquid delivery system of liquid dispenser 200.

In one example embodiment, liquid supply 255 applies a positive pressure provided by a positive pressure source 257 at the entrance of liquid supply channel 251 and a negative pressure (or vacuum) provided by a negative pressure source 259 at the exit of liquid return channel 252. This helps to maintain the pressure inside second liquid chamber 212 at substantially the same pressure (for example, ambient pressure conditions) at the exit of nozzle 220 when the heater 230 is not energized. As a result, flexible membrane 240 is not deflected during a time period of drop dispensing when the heater 230 is not energized.

Liquid is typically supplied to first chamber 211 in a manner similar to liquid chamber refill in a conventional drop on demand device. For example, during a drop dispensing operation using liquid dispenser 200, the liquid is not continuously flowing to first chamber 211 during a drop ejection or dispensing operation. Instead, first chamber 211 is refilled with liquid on an as needed basis that is made necessary by the ejection of a drop of the liquid from first chamber 211 through nozzle 220.

As flexible membrane 240 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention. For example, the second liquid can include properties that increase its ability to remove heat while the second liquid can be an ink. The second liquid can include properties that lower its boiling point when compared to first liquid. The second liquid can include properties that make it a non-corrosive liquid, for example, nonionic liquid, in order to improve and maintain the functionality of heater 230 or increase its lifetime.

A high degree of flexibility in flexible membrane 240 is preferred to effectively transmit the pressure generated by vapor bubble 260 in the working fluid (a second liquid) to the fluid or liquid of interest (a first liquid), for example, ink, located in first chamber 211. In one example embodiment of the invention, this aspect of the invention is achieved by incorporating a bowed shape in a high modulus material membrane. The flexible membrane can be made out of high modulus materials such as alloys, metals, or dielectric materials, to meet fabrication requirements of mechanic strength, durability, or thinness of the flexible membrane. As the surface(s) of flexible membrane 240 is flat, an elastic material can be included with or substituted for a high modulus material during flexible membrane fabrication.

Flexible membrane 240 is attached to a side wall(s) 231 of liquid dispenser 200 to provide a fluidic seal and also to provide a mechanical constraint that facilitates the snap-through behavior of flexible membrane 240. When unactuated or at rest, flexible membrane 240 is in a buckled equilibrium state. The pressure resulting from the expanding vapor bubble 260 produces a lateral force that pushes flexible membrane 240 and causes flexible membrane 240 to snap-through into another buckled equilibrium state. The displacement of flexible membrane 240 pressurizes the liquid in the first liquid chamber 211 and ejects a liquid drop 270 through nozzle 220. This is described in more detail below.

Figure 4:
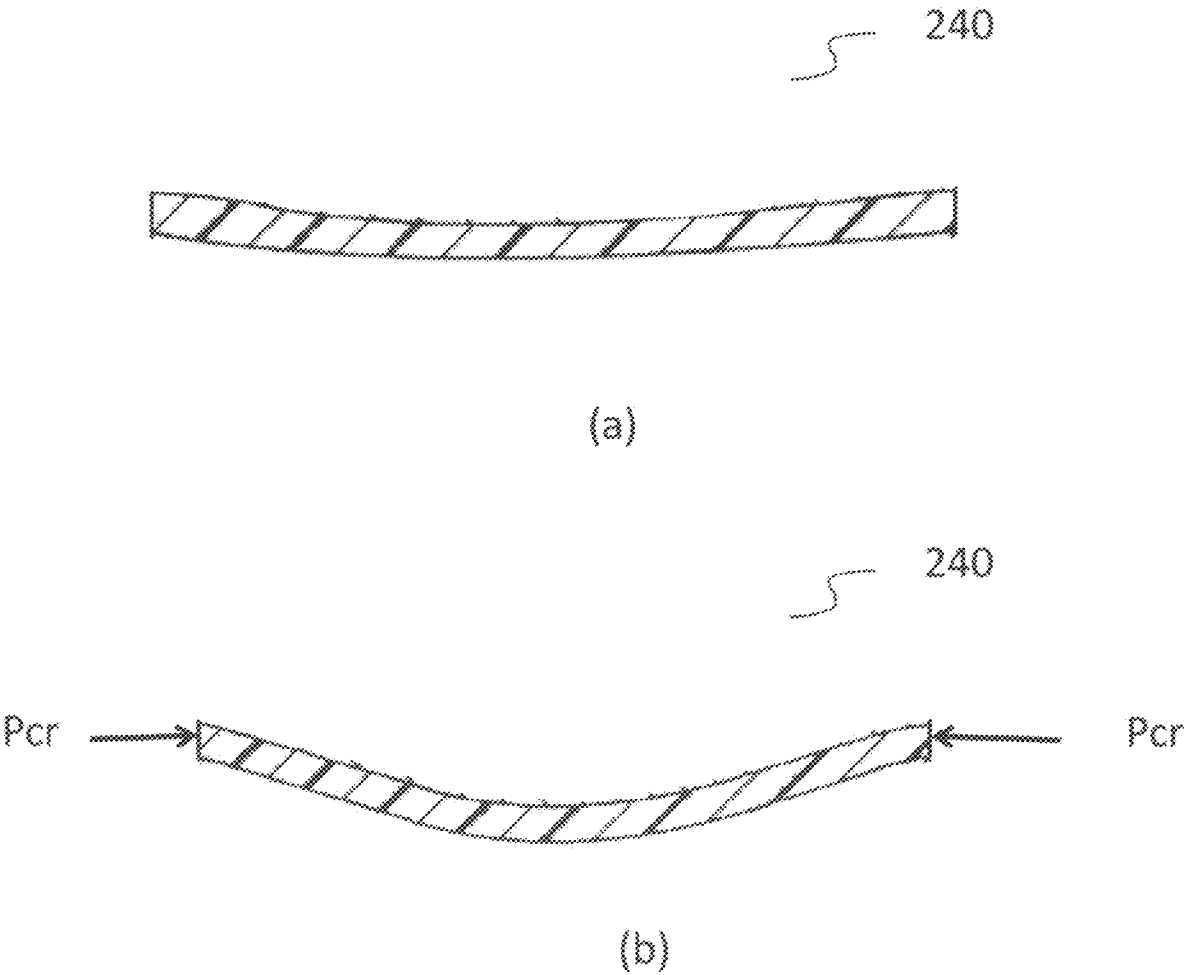
FIGS. 4(*a*)-4(*c*) are schematic cross sectional side views illustrating an example embodiment of a flexible membrane included in an example embodiment of a liquid dispenser made in accordance with the present invention.
Figure 4:
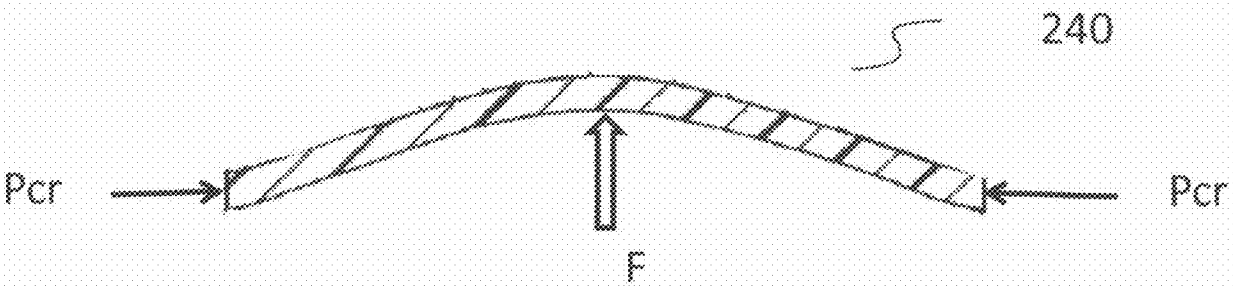

FIGS. 4(*a*)-4(*c*) illustrate details of flexible membrane 240 shown in FIGS. 1 and 2, and describe the principle mode of operation of the present invention. FIG. 4(*a*) shows flexible membrane 240 at a free standing position at an ambient temperature. "Free standing" refers to a theoretical analysis where flexible membrane 240 is removed from liquid dispenser 200, and allowed to free stand without any thermal or mechanical constraints. One feature of the present invention is that flexible membrane 240 is slightly bowing towards the heater 230. This residual shape predisposes the deformable element to bow towards the heater if the ends are compressed.

FIG. 4(*b*) shows the shape of the flexible membrane 240 in the liquid dispenser 200 when heater 230 is not activated. The flexible membrane 240 is fabricated in such a way as to result in residual compressive stress in the flexible membrane at an ambient temperature. The side walks) 231 of liquid dispenser 200 provide constraint to flexible membrane 240 within which the residual compressive stress develops upon cooling down from manufacturing temperature of the flexible membrane. The compressive stress level should be equal or slightly above the Euler buckling stress, Pcr, of the flexible membrane. The concept of buckling and Euler buckling stress, Pcr, is discussed in many strength of materials or structure mechanics textbooks including, for example, Timoshenko, S. P., and Gere, J. M., Theory of Elastic Stability, 2 ed., McGraw-Hill, 1961. The compressive stress, Per, in the flexible membrane causes the bow in the flexible membrane to increase relative to the bow in the uncompressed state shown in FIG. 4(*a*).

Buckling can be analyzed as a mathematical instability. Theoretically, buckling is caused by a bifurcation in the solution to the equations of static equilibrium. As the compressive load on a compressive member is increased, there is a critical buckling load at which the member is able to buckle to another stable position with the application of a small lateral force. Bifurcations buckling, see, for example, Timoshenko and Gere, is sometimes called Euler buckling.

FIG. 4(*c*) illustrates the behavior of the flexible membrane at the critical buckling load when a lateral force F is applied in the direction shown in FIG. 4(*c*). When the force is applied, flexible membrane 240 is caused to make a snap-through transition from one equilibrium position shown in FIG. 4(*b*) to another buckled equilibrium position shown in FIG. 4(*c*). In one example embodiment of the present invention, the residual compressive stress, Pcr, is equal to or slightly above the Euler buckling stress. Under such a condition, the flexible membrane can be driven by the force that is created by the activation of the heater 230. In this manner, a relatively low level of lateral force can produce a comparably large amount of deflection. As this happens, the membrane element is significantly compressed, in order to squeeze through the interval in the central plane that is shorter than its rest length.

Flexible membrane 240 returns to the residual shape illustrated in FIG. 4(*b*) when the lateral force F, produced by the activation of the heater 230, is removed. According to another feature of the present invention, flexible membrane 240 is not bistable in that it does not remain in the buckled-up state when allowed to return to the rest temperature which exhibits the slight buckled-down residual shape (as shown in FIGS. 4(*a*)-4(*c*)). The presence of a second liquid or a circulating second liquid helps to increase the drop ejection frequency by cooling the thermal actuator. The liquid can also damp out unwanted oscillation of the flexible membrane.

Liquid dispenser 200 is typically formed from a semiconductor material (for example, silicon) using semiconductor fabrication techniques (for example, CMOS circuit fabrication techniques, micro-electro mechanical structure (MEMS) fabrication techniques, or a combination of both). Alternatively, liquid dispenser 200 can be formed using conventional materials and fabrication techniques known in the art.

A liquid dispenser array structure made according to the present invention includes a plurality of liquid dispensers 200 described above with reference to FIGS. 1-4(*c*). The plurality of liquid dispensers 200 are formed, for example, integrally formed through a series of material layering and processing steps, on a common substrate typically using the fabrication techniques described above to create a monolithic liquid dispenser structure. When compared to other types of liquid dispensers, monolithic liquid dispenser configurations help to improve the alignment of each nozzle opening relative to other nozzle openings which improves drop deposition accuracy. Monolithic liquid dispenser configurations also help to reduce spacing in between adjacent nozzle openings which can increase the dots per inch (dpi) capability of the device.

The invention has been described in detail with particular reference to certain preferred embodiments thereof, but it will be understood that variations and modifications can be effected within the scope of the invention.

PARTS LIST

| | |
|---|---|
| 200 | Liquid dispenser |
| 211 | First liquid chamber |
| 212 | Second liquid chamber |
| 220 | Nozzle |
| 230 | Heater |
| 230a | Split heater |

-continued

PARTS LIST

| | |
|---|---|
| 230b | Split heater |
| 235 | Center point of heater |
| 231 | Side walls of chamber |
| 240 | Flexible membrane |
| 251 | Liquid supply channel |
| 252 | Liquid return channel |
| 255 | Liquid supply |
| 257 | Pressure source |
| 259 | Pressure source |
| 260 | Vapor bubble |
| 270 | Liquid drop |

The invention claimed is:

1. A liquid dispenser comprising:

a first liquid chamber including a nozzle;

a second liquid chamber;

a liquid supply channel in fluid communication with the second chamber;

a liquid return channel in fluid communication with the second chamber;

a flexible membrane that separates and fluidically seals the first liquid chamber and the second liquid chamber from each other, the flexible membrane including a residual compressive stress that exceeds an onset buckling stress of the flexible membrane, the flexible membrane being located in a first position;

a liquid supply that provides a liquid that flows continuously from the liquid supply through the liquid supply channel through the second liquid chamber through the liquid return channel and back to the liquid supply; and a heater associated with the second liquid chamber, the heater being selectively actuated to create a pressure pulse in the liquid that causes the flexible membrane to move from the first position to a second position to eject liquid through the nozzle of the first liquid chamber.

2. The liquid dispenser of claim 1, the nozzle including a center point, the heater including a center point, and the flexible membrane including a center point, wherein the center points of the nozzle, the heater, and the flexible membrane are collinear relative to each other.

3. The liquid dispenser of claim 1, the first liquid chamber including a first liquid and the second liquid chamber including a second liquid, wherein the first liquid and the second liquid are different liquids.

4. The liquid of dispenser of claim 3, wherein the second liquid has a lower boiling point when compared to the first liquid.

5. The liquid of dispenser of claim 3, wherein the second liquid is a non-corrosive liquid.

6. The liquid dispenser of claim 1, wherein the heater is a split heater.

7. The liquid dispenser of claim 1, wherein the location of the first position is farther away from the nozzle when compared to the location of the second position.

8. The liquid dispenser of claim 1, wherein the heater is a bubble jet type heater that creates the pressure pulse by vaporizing a portion of the liquid in the second chamber.

9. The liquid dispenser of claim 1, wherein the residual compressive stress in the flexible membrane predisposes the flexible membrane to bow towards the heater.

* * * * *